US005927364A

United States Patent [19]

Zacher et al.

[11] Patent Number: 5,927,364

[45] Date of Patent: Jul. 27, 1999

[54] SECURE DIVIDED WINDOW

[75] Inventors: Bryan P. Zacher; Vernon D. Olson, both of Brookings; Kelly D. B. Nordgaard, Aurora; Ardean R. Albers, Flandreau, all of S. Dak.

[73] Assignee: Larson Manufacturing Company, Brookings, S. Dak.

[21] Appl. No.: 08/863,056

[22] Filed: May 23, 1997

[51] Int. Cl.[6] ..... A47H 1/00

[52] U.S. Cl. ..... 160/90; 160/92; 52/456; 52/202

[58] Field of Search ..... 160/90, 92, 371; 52/456, 665; 49/501, 50

[56] References Cited

U.S. PATENT DOCUMENTS

| | | | |
|---|---|---|---|
| 253,732 | 2/1882 | MacDonald . | |
| 332,655 | 12/1885 | Hammill . | |
| 600,904 | 3/1898 | Beall . | |
| 1,476,565 | 12/1923 | Yeager . | |
| 1,587,658 | 6/1926 | Laycock | 160/104 X |
| 1,991,532 | 2/1935 | Wicker | 156/14 |
| 3,080,620 | 3/1963 | Mendelsohn | 160/90 X |
| 3,081,503 | 3/1963 | Mendelsohn | 160/90 X |
| 3,749,432 | 7/1973 | Janssen | 52/665 X |
| 4,127,156 | 11/1978 | Brandt | 160/179 |
| 4,970,840 | 11/1990 | Ouellette et al. | 52/456 X |
| 5,177,920 | 1/1993 | Rafeld | 52/665 X |
| 5,307,599 | 5/1994 | Herbst et al. | 52/207 |
| 5,351,459 | 10/1994 | Kassl et al. | 52/456 X |

FOREIGN PATENT DOCUMENTS

| | | | |
|---|---|---|---|
| 30665 | 12/1897 | United Kingdom | 160/104 |

*Primary Examiner*—Blair M. Johnson
*Attorney, Agent, or Firm*—Kinney & Lange, P.A.

[57] ABSTRACT

A window with an outer frame for mounting in a window opening in a structure this outer frame having on the sides thereof sash tracks or channels facing one another across the window space. Window sashes containing a single window pane are positioned between and securable in such channels in a manner allowing them to be slid therealong for opening and closing the window. Protuberances extending from the window frame secure the window sashes in the channels so as to allow sliding therealong, and removing such window sashes from those channels is accomplished by removing the protuberances therefrom. A blocking panel is positionable in the outer frame in the absence of such window sashes, and can be removed therefrom in the absence of such sashes but not when the sashes are present. A relatively rigid tube structure that can be formed in a coarse mesh is provided for affixing to the panel frame in the blocking panel as is a finer mesh screen structure to thereby provide security against entrance through the window space.

20 Claims, 8 Drawing Sheets

SECURE DIVIDED WINDOW

BACKGROUND OF THE INVENTION

The present invention relates to windows having frames with multiple tracks or channels therein for sashes and, more particularly, for features other than sashes such as screens.

Windows, including windows for doors such as storm doors, are, in many instances, desired to have features beyond a pair of window sashes therein formed as frames containing one or more transparent windowpanes. Of course, most commonly, such windows are desired to have a mesh screen added therein to the pair of window sashes so that portions of the window can be left open by adjusting the positions of one or both sashes without also allowing insects to pass therethrough. In addition, although windows are often constructed with a single large pane being used in each sash, there is a desire to have that pane appear to be divided into a plurality of smaller windowpanes, or windowlights, by placing a relatively coarse rectangular mesh, or other shaped mesh, in front of such a single windowpane so as to appear to divide that single pane into several Furthermore, there is often a desire to provide security against intruders entering the building in which the window is positioned by going through that window. Thus, there is often a need to have security bars or a grill or the like incorporated in the window so as to prevent intruders passing therethrough by merely breaking the window. The presence of so many features in a window has, however, caused windows in the past to be complicated, bulky or expensive, or all three. Thus, there is a desire to provide a window with these features which is aesthetically pleasing, relatively secure and economical.

SUMMARY OF THE INVENTION

The present invention provides a window with an outer frame for mounting in a window opening in a structure. This outer frame has side members therein which include window sash tracks, or channels, that open, or face, one another across the window space within that frame. Window sashes formed of a window frame containing at least one transparent windowpane can be positioned between and secured in such channels so as to allow their being slid therealong to open and close the window. Protuberances extending from the windowframe secure the window sashes between and allow sliding along the channels, and removing such window sashes from those channels is accomplished by removing protuberances from the channels.

A blocking panel is positionable in the outer frame in the absence of such window sashes and can also be removed therefrom in such sash absences, but is not removable when the window sashes are present. A relatively rigid tube structure, that can be formed in a coarse mesh, is provided affixed to a panel frame provided in the blocking panel, and a screen structure with a finer mesh is also provided in that panel. Furthermore, a flexible blocking strip can be located between the panel frame and the outer frame to further secure the panel in the outer frame against forcible intrusion. The panel channels in the outer frame at the ends of the side members prevent the panel from being pulled out of the outer frame.

DETAILED DESCRIPTION OF THE PREFERRED EMBODIMENTS

Figure 1A:
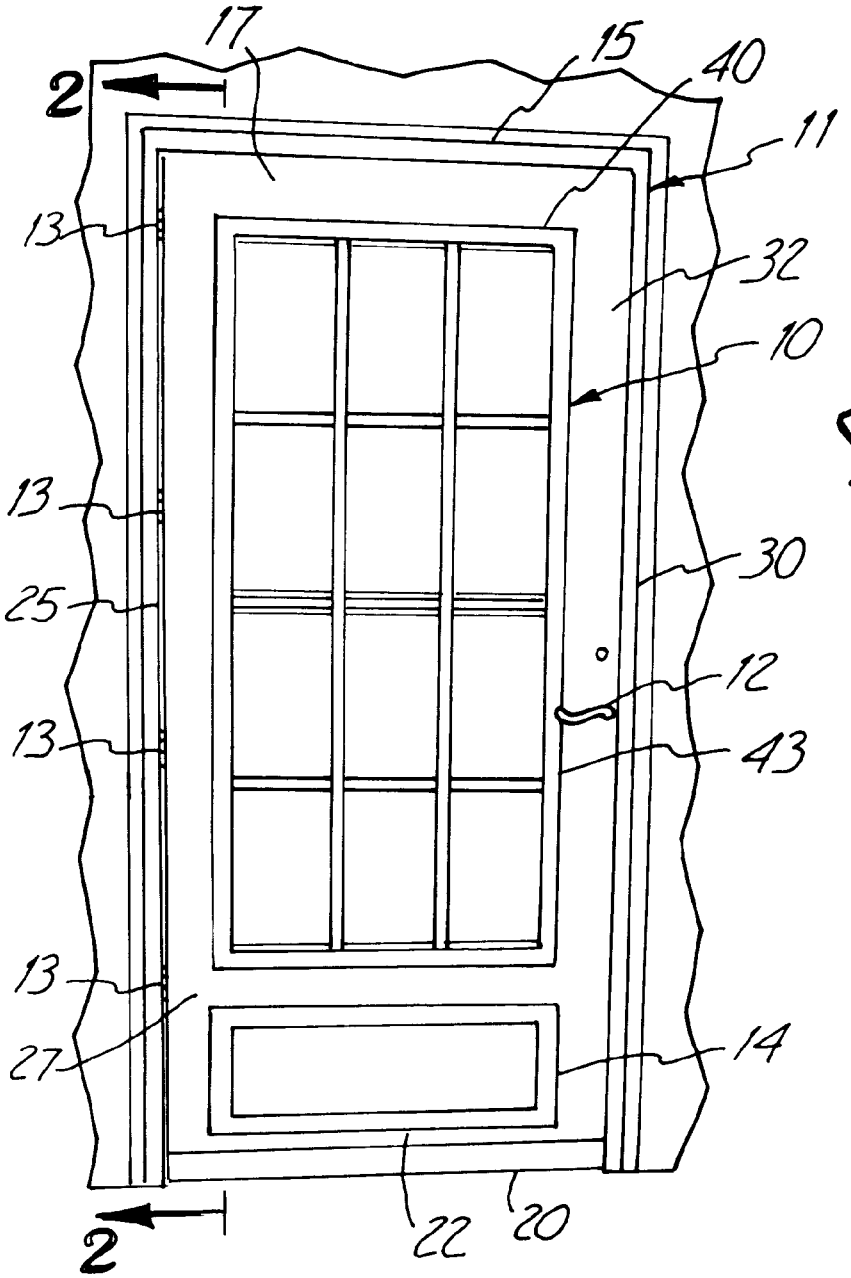
FIGS. 1A and 1B show a portion of a building having in a door opening therein a door structure with a window arrangement in a window opening therein embodying the present invention with window sashes in alternative positions.
Figure 1B:
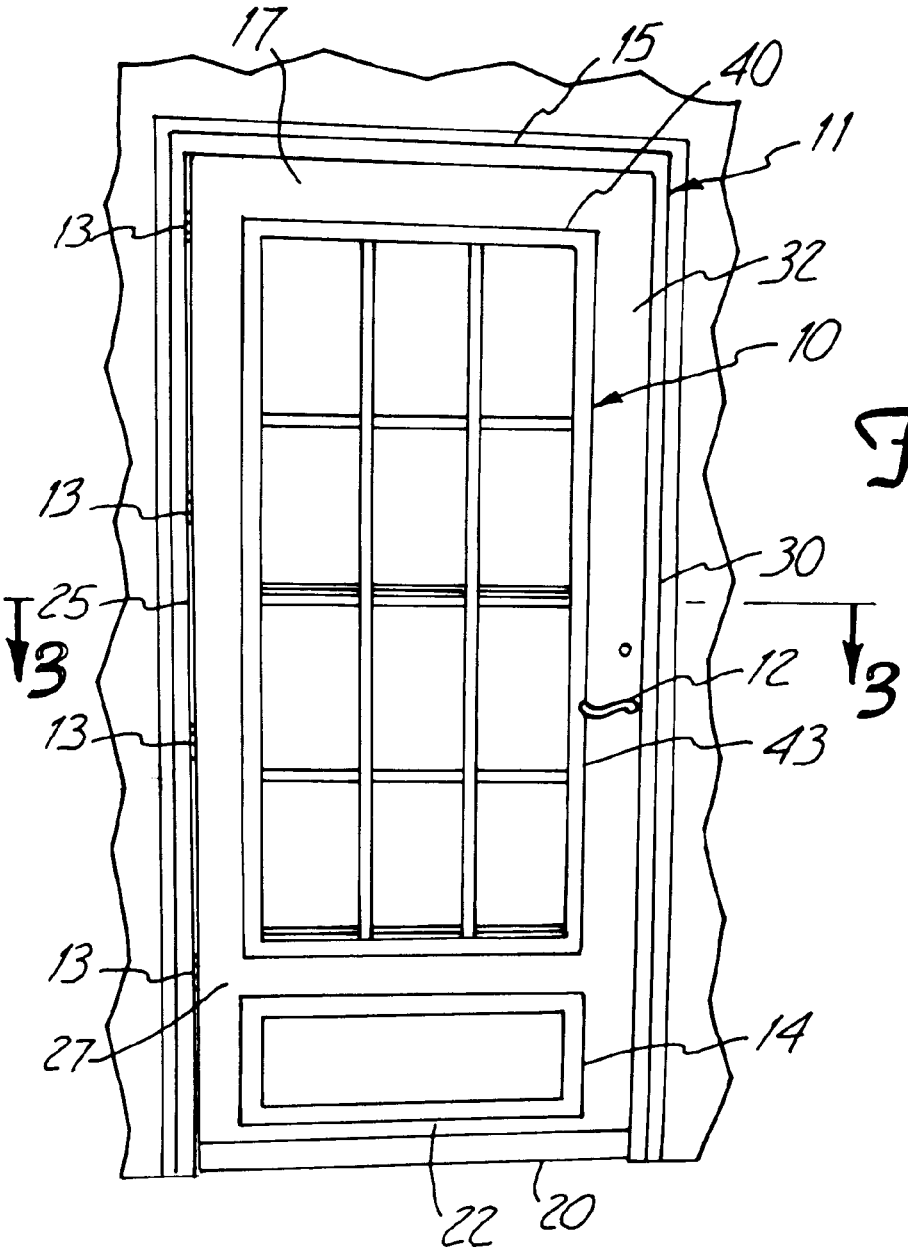

The present invention provides a decorative and secure window arrangement, 10, shown mounted in a storm door, 11, in FIGS. 1A and 1B. A handle, 12, is shown on the right side of door 11 as a part of a door latch mechanism for keeping the door against the jam when closed, and hinges, 13, are shown joining the door to the supporting structure therearound. A decorative panel, 14, is shown in the kick-plate portion of door 11. FIG. 1A also indicates that a vertical cross-section view is provided in FIG. 2, and FIG. 1B indicates that a horizontal cross-section view is provided in FIG. 3.

Figure 2:
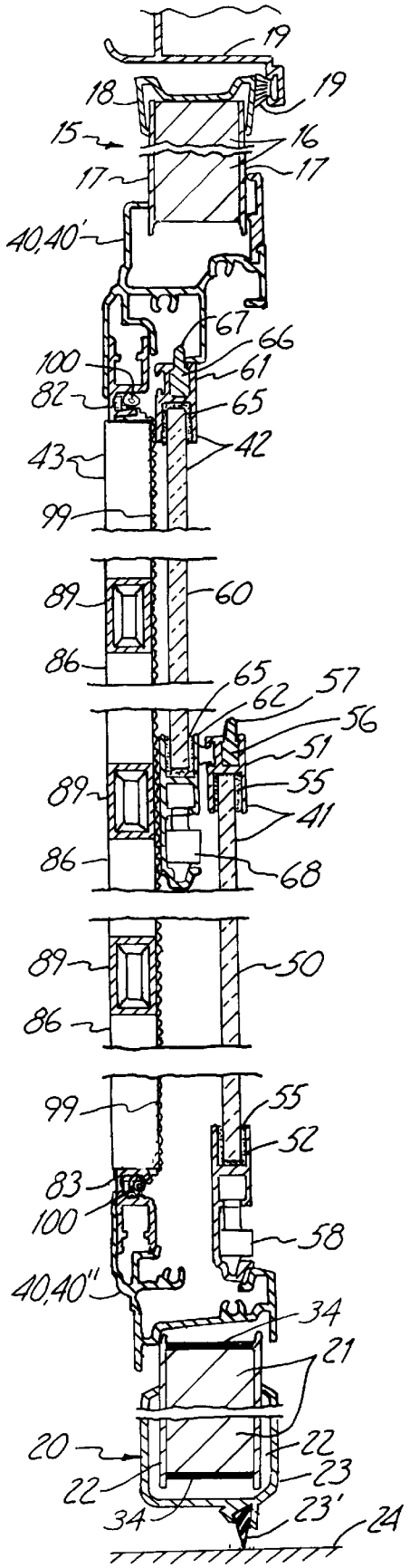
FIG. 2 shows a cross section view of a portion of the structure shown in FIG. 1A.
Figure 3:
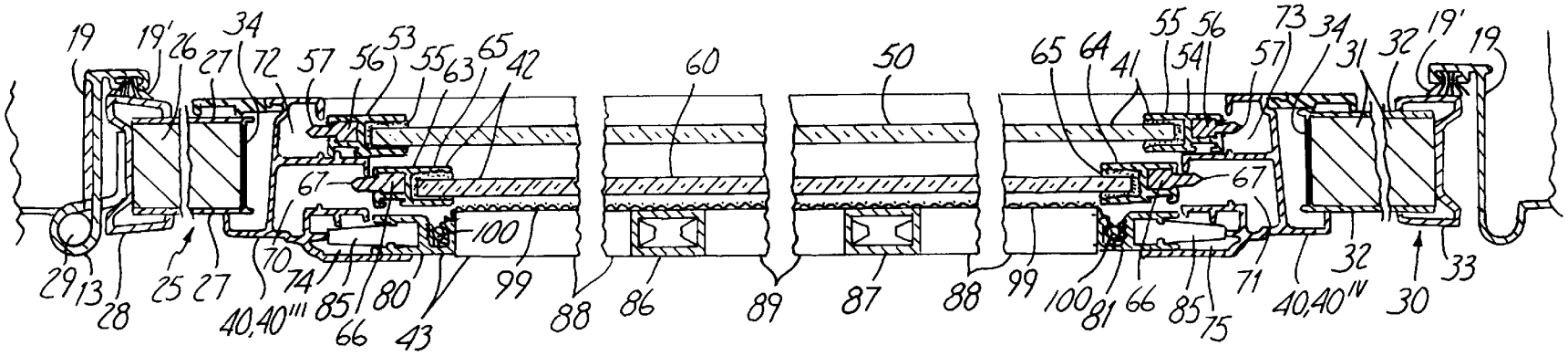
FIG. 3 shows another cross section view of a portion of the structure shown in FIG. 1B.

Turning to FIGS. 2 and 3, storm door 11 is shown in cross-sectional views that are interrupted in several places to remove unneeded view portions to thereby limit the extent of the views shown. These interrupted cross-sectional views show that door 11 is formed of rails and stiles that appear integrated about a window based on combining aluminum extrusions capping aluminum patterned sheets, or cladding, laminated to underlying wooden, or composite board, framing. Thus, an upper rail, 15, is shown in FIG. 2 formed of an upper rail wooden or composite board framing member, 16, that is laminated on both the front and the back sides thereof with patterned aluminum cladding, 17. The upper side of this structure is capped with an aluminum extrusion cap, 18, press-fitted over the outer sides of cladding 17 and framing member 16 that forms the exposed outer edge of door 11 at the top thereof. An aluminum door frame, 19, for use about door 11 is affixed to the building structure in the opening therein for door I 1, and has a brush sealer, 19', against which cap 18 is forced when door 11 is closed against door frame 19 to aid in sealing that door against adverse weather conditions.

Similarly in FIG. 2, a lower rail, 20, is formed from a lower wooden or composite board framing member, 21, that is laminated on the front and back sides thereof with aluminum cladding, 22. The resulting structure is capped at its lower side with an aluminum extrusion cap, 23, press-fitted over the outer sides of cladding 22 and framing member 21 to form the exposed outer lower edge of door 11. A polymeric material wiping blade, 23', is positioned in cap 23 to wipe against the threshold or other surface, 24, beneath door 11, as installed in the building structure, as door 11 is closed to aid in sealing same against adverse weather conditions.

In FIG. 3, a left side or hinge side stile, 25, is shown formed of a wooden or composite board framing member, 26, that is laminated on both the front and back sides by aluminum cladding, 27. This arrangement is capped at its outer side by an aluminum extrusion cap, 28, press-fitted over the outer sides of cladding 27 and framing member 26 to form the exposed outer left-hand edge of door 11. Hinge 13 is formed as part of door frame 19 which again has brush sealer 19' engage cap 28 when door 11 is closed against frame 19 for weather sealing purposes. The remaining portion of hinge 13 is affixed to, or is a part of, cap 28 which is positioned in the frame portion of hinge 13 in door frame 19 to be joined therewith by a hinge pin, 29.

Finally, a right-hand or latch edge stile, 30, is formed by a righthand wooden or composite board framing member, 31, that again is laminated with aluminum cladding, 32, on both the front and back sides thereof. Here too, the resulting structure is capped with an aluminum extrusion end cap, 33, press-fitted over the outer sides of cladding 32 and framing member 31 to form the exposed outer right-hand edge of door 11. Door frame 19 again has therein brush sealer 19' which is forced against cap 33 when door 11 is closed against door frame 19.

The sides of left-hand framing member 26 of stile 25 and right-hand framing member 31 of stile 30 facing inward and those facing outward are coated with a waterproof sealant, 34 for a few inches above lower framing member 21 inner facing side and its bottom side, respectively. Lower framing member 21 of rail 20 has its inner facing side coated with waterproof sealant 34, but also has the bottom side of that member coated with sealant 34.

The inner facing sides of rails 15 and 20, and of stiles 25 and of storm door 11, provided by the corresponding framing members and aluminum cladding, form a window opening in that door over which are press-fitted sections of a multiple channel, or track, combination frame, 40, that is to contain a combination of windows, a screen and a grid. As seen in FIG. 2, upper combination frame member, 40', is press-fitted over cladding 17 on either side of upper framing member 16. A corresponding lower combination frame member, 40", can also be seen in FIG. 2 fitted against cladding 22 on one side of lower framing member 21 leaving a gap on the remaining side. Turning to FIG. 3, a left-hand combination frame member, 40'", can be seen press-fitted over cladding 27 on either side of left-hand side framing member 26, as can a right-hand combination frame member, $\mathbf{40}^{iv}$, shown press-fitted over cladding 32 on either side of right-hand framing member 31.

Combination frame 40 has left-hand combination frame member 40'" and right-hand combination frame member $\mathbf{40}^{iv}$ each with three side-by-side open channel arrangements, or tracks, extending along the length thereof and facing corresponding ones of those channels in the other member across the space therebetween. One such channel arrangement or track supports a lower window, 41, that is slidable therein. Another such channel arrangement or track supports an upper window 42, that also is slidable therein, and a final such channel arrangement or track supports a combined grid and screen panel structure, 43.

Lower window 41 is formed of a windowpane, 50, mounted in a lower sash formed of upper and lower sash members, 51 and 52, as seen in FIG. 2, and right- and left-hand sash members, 53 and 54, as seen in FIG. 3. Windowpane 50 is inserted in open channels or slots in each of these window 41 sash members that face inside so that those channels in opposite sash members face toward one another. Windowpane 50 is maintained in this window sash by the use of a polymeric material sealer, 55, wrapped around each edge of windowpane 50 over which the corresponding open channel or slot in each of window 41 sash members 51, 52, 53 and 54 is press-fitted. The sash members are joined at the corners to adjacent ones thereof by corner lock keys including upper corner lock keys, or tilt keys, 56, having protrusions, 57, protruding into an adjacent channel in combination frame 40. Spring-loaded, finger-pull latches, 58, are provided in lower sash member 52 to also removably protrude into this same channel in combination frame 40.

Similarly, upper window 42 is formed of a windowpane, 60, positioned in an upper sash. The sash for upper window 42 comprises an upper sash member, 61, and a lower sash member, 62, seen in FIG. 2 with windowpane 60 therein. In FIG. 3, upper window 42 has windowpane 60 shown in a left-hand sash member, 63, and in a right-hand sash member, 64. Windowpane 60 is, here too, inserted in open channels or slots in each of these window 42 sash members that face inside so that those channels in opposite sash members face toward one another. Again, windowpane 60 is maintained in the window 42 sash members by a polymeric sealer, 65, wrapped about each end edge of window pane 60 over which the corresponding open channel or slot in each of window 42 sash members 61, 62, 63 and 64 is press-fitted as above. Here again, the sash members are joined at the corners to adjacent ones thereof by corner lock keys including upper corner lock keys, or tilt keys, 66, having protrusions, 67, protruding into an adjacent channel in combination frame 40. Spring-loaded, finger-pull latches, 68, are provided in lower sash member 62 to also removably protrude into this same channel in combination frame 40.

In FIG. 2, upper window 42 is shown in its uppermost position. Lower window 41, on the other hand, is shown in its lowermost position so that the entire opening within combination frame 40 is covered by windows 41 and 42. Upper window 42 can, however, be lowered by sliding its protrusions in the corresponding frame 40 channel to a new position that reduces the blockage thereby of the upper portion of the opening within combination frame 40. In FIG. 3, upper window 42 is shown in a lowered position. Similarly, lower window 41 can be raised by sliding its protrusions to a new position in the corresponding frame 40 channel to reduce the blockage thereby of the lower portion of the opening in combination frame 40.

Upper window 42 can be removed from combination frame 40 only if lower window 41 has been previously removed since they overlap in the space contained in frame 40. In addition, as can be seen in FIG. 3, upper window 42 can be removed from combination frame 40 only if the protrusions 57 and protruding portions of latches 58 are removed from the channel in frame 40 into which they protrude. That is, the channel facing arrangement in combination frame 40 has a pair of facing channels, 70 and 71, in side combination frame members 40'" and $\mathbf{40}^{iv}$. Channels 70 and 71 have corresponding sides coming close enough toward one another across the space in frame 40 so as to block movement of window 42 in FIG. 3 from either to the front or to the back to any significant extent so long as protrusions 57 and protruding portions of latches 58 are in those channels.

As can be seen in FIG. 3, lower window 41 is between a further pair of facing channels, 72 and 73, in side combination frame members 40'" and $\mathbf{40}^{iv}$. Channels 70 and 71, in the channel facing arrangement in side combination frame members 40'" and $\mathbf{40}^{iv}$, are positioned between facing channels 72 and 73, considered as a pair, and a further pair of facing channels, 74 and 75, provided for panel structure 43. Channels 72 and 73 also have corresponding sides thereof extending toward one another across the space in frame 40 sufficiently to block movement of window 41 from front or back movement in FIG. 3 to any significant extent so long as protrusions 67 and protruding portions of latches 68 are in those channels. On the other hand, lower window 41 can be moved to the back if protrusions 67 and protruding portions of latches 68 are removed from channels 72 and 73 without regard to upper window 42.

Lower window 41 is removed from between channels 72 and 73 by pulling latches 68 inward against the springs used therewith and rotating window 41 upward toward the back on protrusions 67. Thereafter, window 41 is rotated about an axis more or less perpendicular to the plane of frame 40 sufficiently to get protrusions 67 out of channels 72 and 73 to then allow full rearward movement of that window. Upper window 42 can then be removed rearward in the same manner, rotating first upward about protrusions 57 and performing another rotation about an axis more or less perpendicular to the plane of frame 40 to free the window from that frame.

The presence of window 41 in its channel position prevents, as indicated above, window 42 from being moved inward, or to the back or the right in FIG. 3, and the presence of both these windows in their respective channel positions prevents any significant inward movement (again, movement to the right in FIG. 3) of combination grid and screen panel structure 43. The left side portions of combination frame 40 as shown in FIGS. 2 and 3 that are the left-side channel walls for the channel arrangement in frame 40 corresponding to panel structure 43 also prevent that structure from being moved outward, or to the left, in either of those figures. Thus, windows 41 and 42 present in their positions between their respective channels, with the protuberances associated therewith protruding into those channels, cannot be moved significantly inward and, as a result, neither can panel structure 43. Thus, panel structure 43, if sufficiently strong, provides a security structure protecting against inward entry through the window opening in storm door 11 by someone attempting to come through the space enclosed within combination frame 40. In addition, the coarse grid structure, i.e. the cross bars as opposed to the screen (forming a fine mesh structure), are also configured and positioned to appear as dividers of window panes 50 and 60 into rectangular sections so as to make them appear to an outside observer as divided windows featuring a plurality of windowlights.

Figure 4:
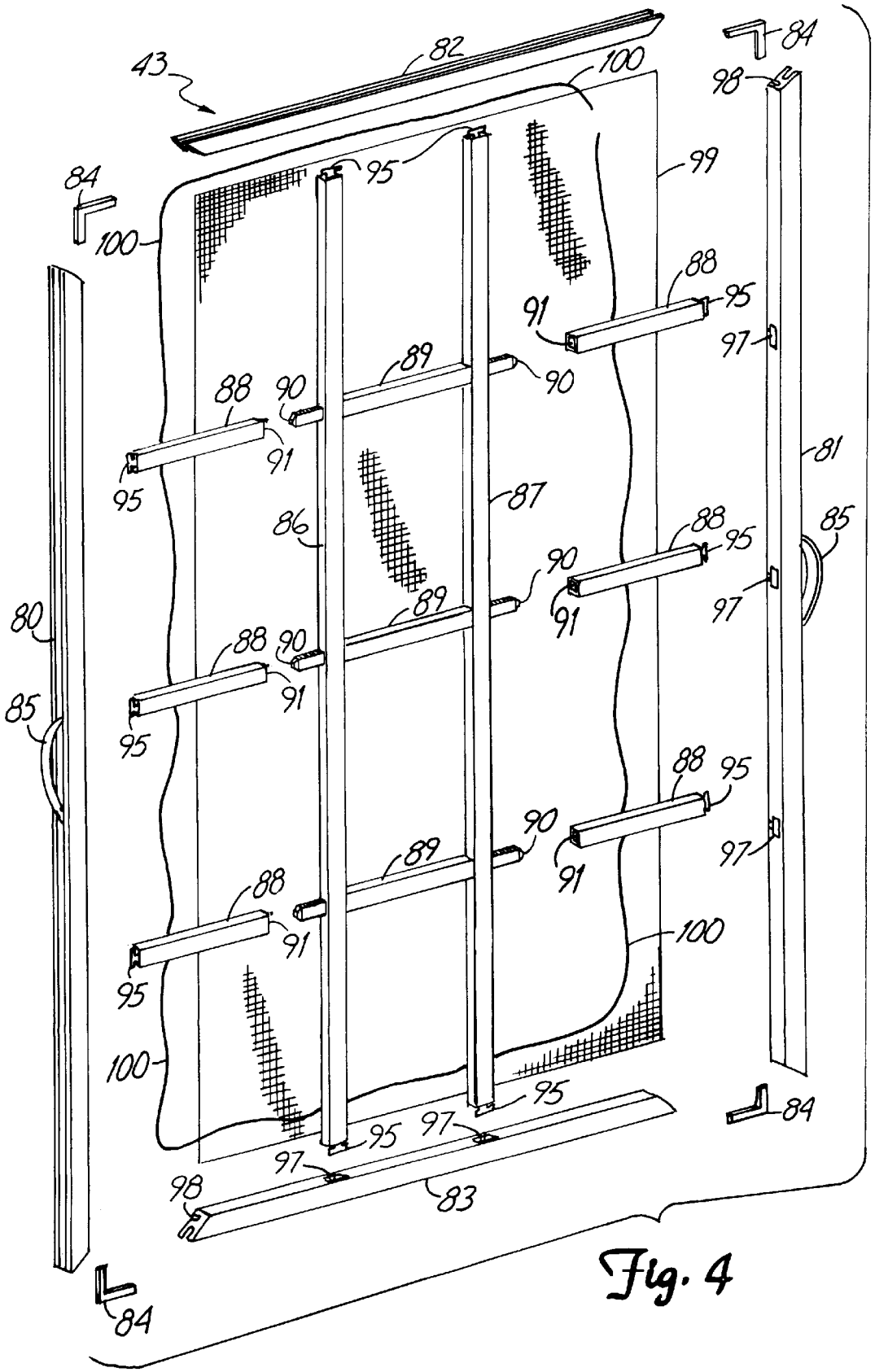
FIG. 4 shows an exploded view of a portion of the structure shown in FIGS. 1A and 1B, and FIGS. 5 through 10 show fragmentary cross section views of various portions of the structure shown in FIGS. 1A and 1B.

FIG. 4 shows a partially exploded view of many of the components of combination grid and screen panel structure 43. Panel structure 43 has a pair of opposite side extruded aluminum stiles, 80 and 81, which are joined to a pair of opposite end extruded aluminum rails, 82 and 83 by four metal and polymeric materials corner keys, 84, one for each corner, which lock stiles 80 and 81 into a rectangular panel frame with rails 82 and 83. A pair of semicircular-like flexible polymeric material spring latches, 85, are set into openings in outside facing channels provided in styles 80 and 81. Spring latches 85 are used in keeping panel structure 43 locked into channels 74 and 75 in combination frame 40.

The panel frame formed of styles 80 and 81 and rails 82 and 83 of panel structure 43 is constructed about the coarse grid structure. This coarse grid structure is formed by a pair of vertical, muntin-like, rectangular cross-section hollow, aluminum extruded tubes, 86 and 87, and of nine cross pieces used in three rows of three to simulate sash bars for the spacing of vertical tubes 86 and 87 apart from one another and apart from stiles 80 and 81. Six cross pieces, 88, are divided into two groups of three to separate stile 80 and vertical tube 86 from one another, and to separate stile 81 and vertical tube 87 from one another. A further set of three cross pieces, 89, are used to separate vertical tubes 86 and 87 from one another. In each instance, cross pieces 88 and 89 are formed by rectangular cross-section hollow, aluminum extruded tubes.

Figure 5:
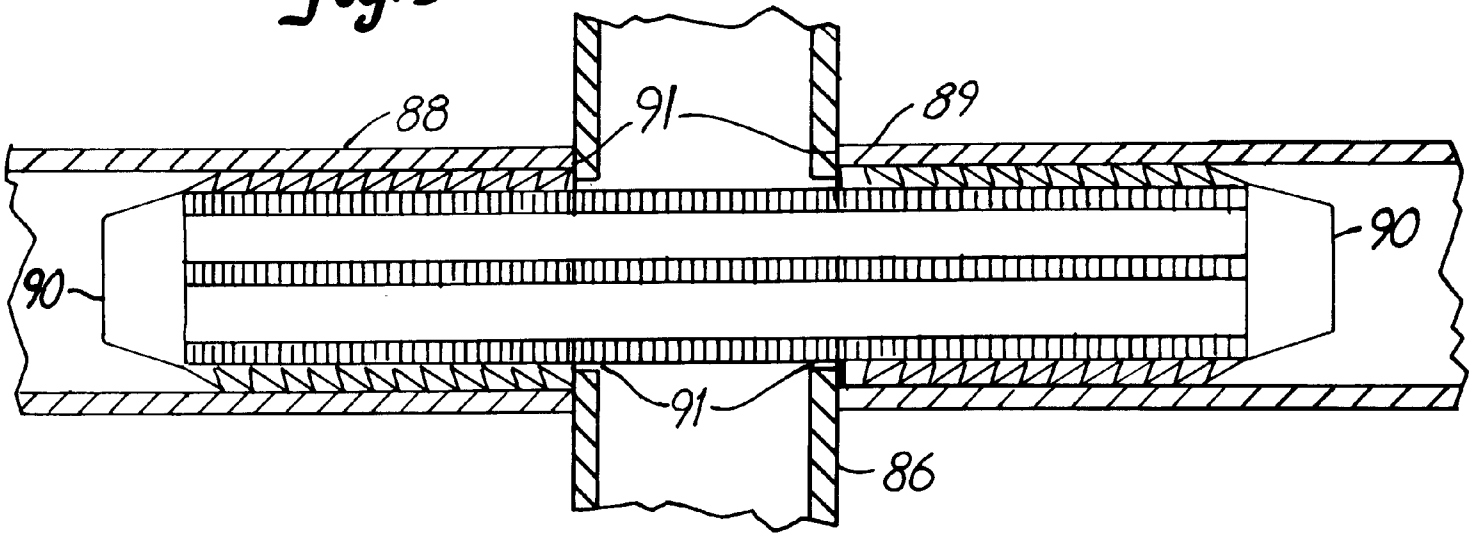
Figure 6:
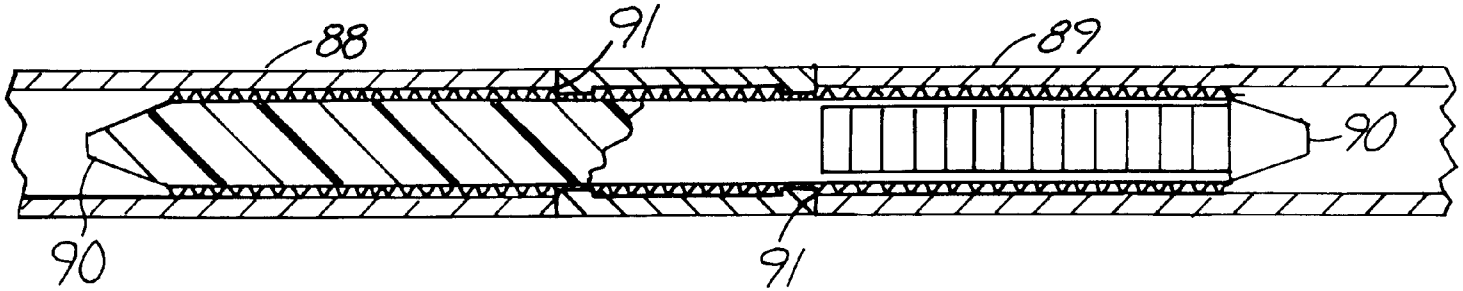

The coarse grid structure is constructed by connecting each of cross pieces 88 and 89 to their corresponding locations in vertical tubes 86 and 87. FIG. 5 shows one of the connection points along vertical tube 86 in cross section view with just the facing metal sides of these cross pieces 88 and 89, and of vertical tube 86, as shown in FIG. 4, removed. As can be seen, a portion of polymeric material cross key, 90, is fitted into the hollow opening in cross piece 88 adjacent the end thereof to be joined with vertical tube 86. A similar hollow opening is provided in cross piece 89. A pair of openings, 91, are provided in vertical tube 86 across from one another where cross pieces 88 and 89 are to be joined with that vertical tube. This allows cross key 90 to be inserted through vertical tube 86 and both openings 91 into the hollows of cross pieces 88 and 89 to hold then to the sides of vertical tube 86. FIG. 6 shows a top cross-section view of the same joint shown in FIG. 5, but with a portion of tube 86 removed along with removing what otherwise would be the upward facing metal sides of cross pieces 88 and 89. As can be seen, cross key 90 has a substantial number of flexible "teeth" jutting out from the sides thereof to frictionally lock these keys into the hollow openings of cross pieces 88 and 89 and between openings 91 in vertical tube 86.

Figure 7:
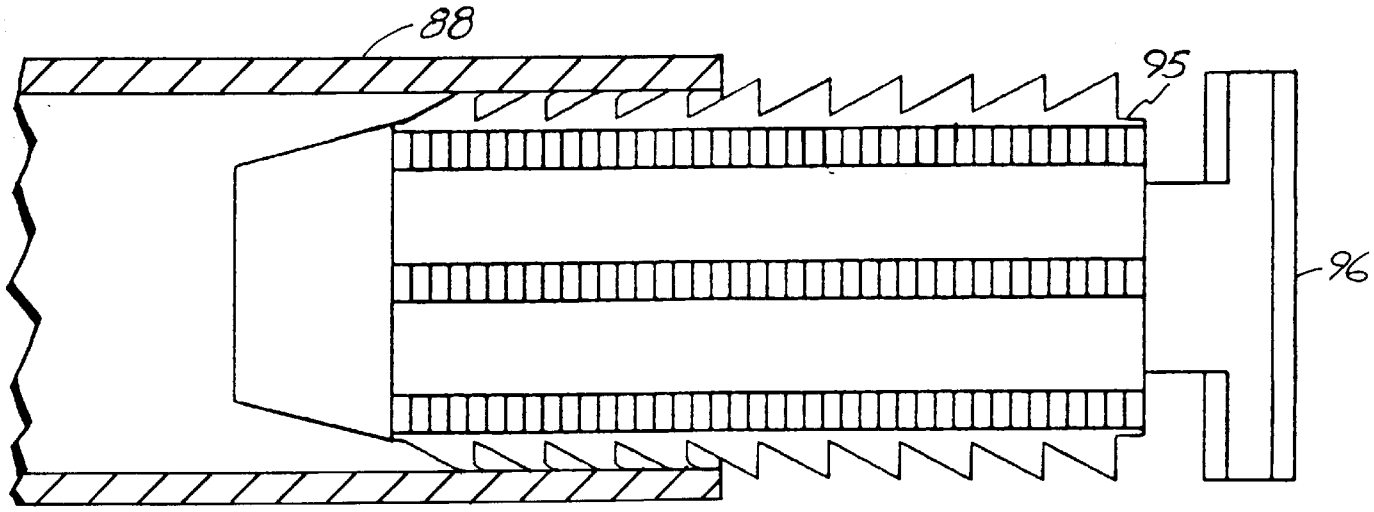
Figure 8:
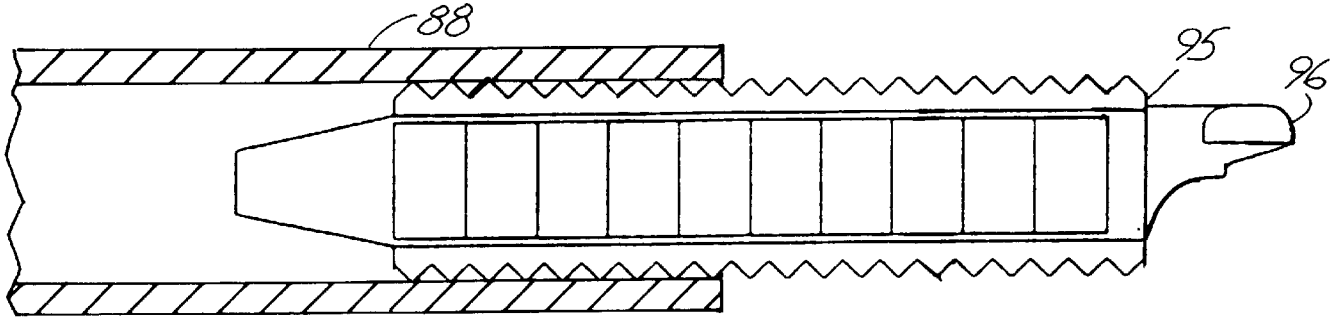

Although cross keys 90 are inserted in the hollow openings at both ends of cross pieces 89, they are used only at one of the ends of cross pieces 88, the ends thereof that are to be connected to vertical tubes 86 and 87. At the other ends of each of cross pieces 88, and at both ends of vertical tubes 86 and 87, there are inserted polymeric material end keys, 95, each having an exposed end shaped more or less like a "T" extending past the end of that cross piece 88 or of that one of vertical tubes 86 and 87 in which it is used. FIG. 7 shows a cross-section view of an end of a cross piece 88 with the facing metal side thereof shown in FIG. 4 removed, that cross piece having an end key 95 partially inserted into the hollow opening therein. A top view of the same cross piece 88 with what otherwise would be the upward facing metal side of that cross piece removed is shown in FIG. 8 to provide the cross-section view shown there. Again, a large plurality of flexible "teeth" are provided on end key 95 to frictionally lock that key into the end of cross piece 88 (or of one of vertical tube 86 and 87 if used there instead). The tee end, 96, of end key 95 fits into corresponding side openings, 97, along a slot, 98, in each of stiles 80 and 81 for connecting cross pieces 88 thereto. Similarly, such tee ends 96 of end keys 95 inserted into vertical tubes 86 and 87 fit into openings 97 along slot 98 in each of rails 82 and 83 for connecting these tubes thereto.

Figure 9:
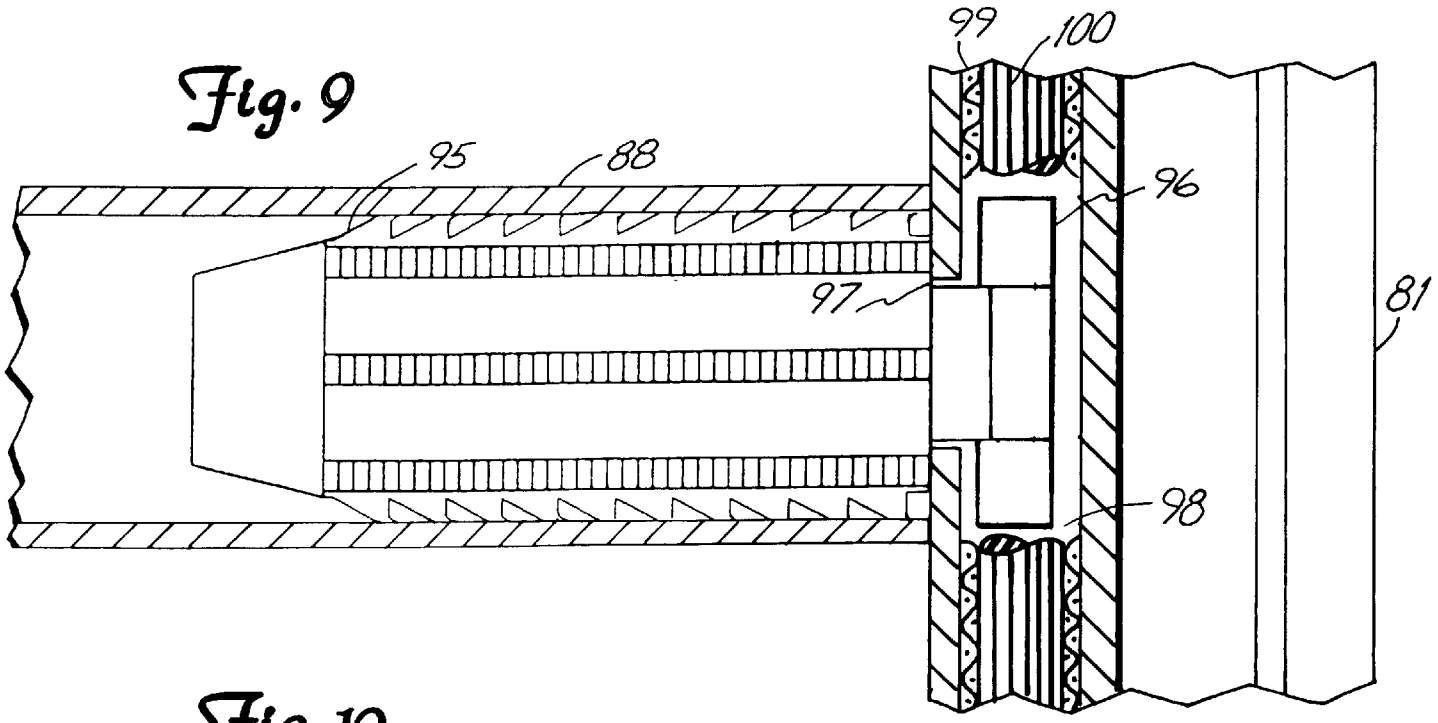
Figure 10:
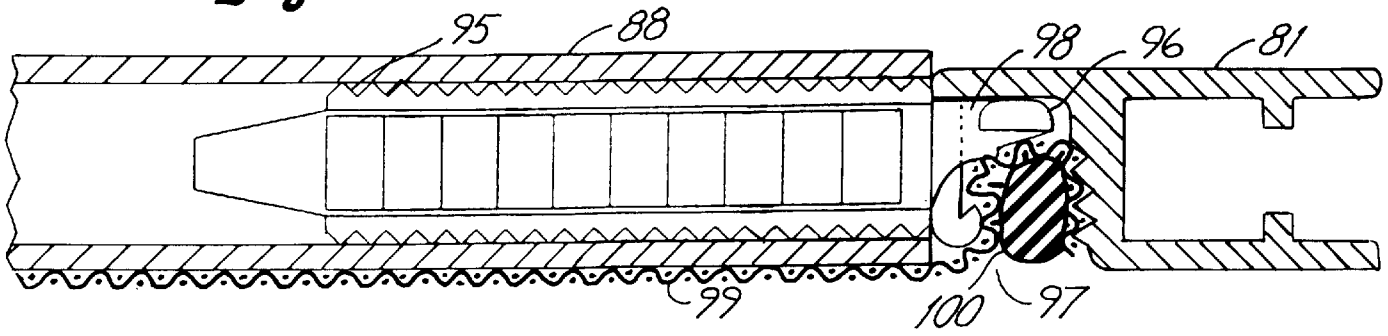

FIG. 9 shows this joining arrangement in greater detail in again a cross-section view with a facing side removed from cross piece 88 as well as a facing portion of stile 81 being removed therefrom. As can be seen, tee end 96 of end key 95 fits through opening 97 into slot 98 of stile 81. Tee end 96 of end key 95 is held in slot 98, as well as portions of a screen, 99, serving as the fine mesh material to cover the window space in the door for insect exclusion. This key end and this screen portion are both held in slot 98 by a polymeric material "cord", 100. Cord 100 is forced deformed into slot 98 after tee end 96 of end key 95 is inserted therein and after screen material 99 is placed over the panel frame of panel structure 43 with edge portions thereof positioned over slot 98 and tee end 96, these edge portions of screen 99 being forced also into slot 98 by the forcing of cord material 100 therein.

This structural arrangement for panel structure 43 results in a strong barrier to entry for a would-be intruder seeking entry through the window opening in door 11 as it would be in other kinds of window openings. Careful configuring and fabrication of vertical tubes 86 and 87, and of cross pieces 88 and 89, along with careful assembly thereof together will result in a grid which will give an outside observer the impression of it being composed of window dividers to result in the further impression of the upper and lower windows being formed of windowlights rather than single windowpanes.

Although the present invention has been described with reference to preferred embodiments workers skilled in the art will recognize that changes may be made in form and detail without departing from the spirit and scope of the invention.

What is claimed is:

1. A window having an outer frame for mounting in a window opening provided in a structure, said outer frame having side members therein each including an initial window sash channel that opens toward that corresponding other said initial window sash channel, said window comprising:

an initial window sash having a window frame with at least one pane therein, said initial window sash being positionable between said corresponding initial window sash channels and movably secured therebetween so as to be slidable therealong, said initial window sash also being removable from a secured position between said corresponding initial window sash channels; and a blocking panel insertable in said outer frame if said initial window sash is removed from said secured position between said corresponding window sash channels because of said panel having to pass between said corresponding initial window sash channels to be inserted in said outer frame, and said blocking panel being removable from said outer frame if said initial window sash is removed from said secured position between said corresponding initial window sash channels, said blocking panel comprising:

a panel frame;

a security structure comprising a plurality of relatively rigid members held by said panel frame with at least one said member being separated from another by a relatively large spacing; and a screen structure comprising a mesh formed of a plurality of flexible strands held by said panel frame with at least some of said strands being separated from others by relatively small spacings, said screen structure being positioned over said security structure in said blocking panel.

2. The apparatus of claim 1 wherein said outer frame has a first end member joining two ends of said side members thereof and a second end member joining those remaining ends of said side members thereof, said first and second end members each having a panel channel therein that opens toward that corresponding other said panel channel, said panel channels each having an inner side and an outer side with a said panel channel outer side separated from that corresponding other said panel channel outer side of that remaining said panel channel member by less than that separation occurring between those corresponding said inner sides of said panel channels, said outer sides of said panel channels also being separated from one another by less than that distance occurring between corresponding opposite ends of said blocking panel.

3. The apparatus of claim 1 wherein said side members of said outer frame each have a complementary window sash channel therein located adjacent a side of said initial window sash channel therein, and further comprising a complementary window sash having a window frame with at least one pane therein, said complementary window sash being positionable between said corresponding complementary window sash channels and movably secured therebetween so as to be slidable therealong, said complementary window sash also being removable from a secured position between said corresponding initial window sash channels.

4. The apparatus of claim 1 wherein said initial window sash is secured between said corresponding initial window sash channels by protuberances which protrude from said initial sash window frame into said corresponding initial window sash channels and wherein said initial window sash is removable from said corresponding initial window sash channels by said protuberances being removed therefrom.

5. The apparatus of claim 1 wherein said outer frame side members each have a supplementary channel with two side walls that opens toward that corresponding other said supplementary channel and between which said blocking panel is positioned if inserted in said outer frame, and wherein a flexible blocking strip mounted on said panel frame is located at least in part in each said supplementary channel between two side walls thereof and between said panel frame and a wall of that said supplementary channel joining said two sidewalls thereof if said blocking panel is inserted in said outer frame.

6. The apparatus of claim 1 wherein those said relatively rigid members in said security structure include relatively rigid tubes.

7. The apparatus of claim 1 wherein said structure is a door.

8. The apparatus of claim 1 wherein said screen structure is held by said panel frame by having portions thereof near edges thereof positioned in a slot in said panel frame with an elastomeric body positioned in said slot thereover.

9. The apparatus of claim 2 wherein said outer frame side members each have a supplementary channel with two side walls that opens toward that corresponding other said supplementary channel and between which said blocking panel is positioned if inserted in said outer frame, and wherein a flexible blocking strip mounted on said panel frame is located at least in part in each said supplementary channel between two side walls thereof and between said panel frame and a wall of that said supplementary channel joining said two sidewalls thereof if said blocking panel is inserted in said outer frame.

10. The apparatus of claim 2 wherein said side members of said outer frame each have a complementary window sash channel therein located adjacent a side of said initial window sash channel therein, and further comprising a complementary window sash having a window frame with at least one pane therein, said complementary window sash being positionable between said corresponding complementary window sash channels and movably secured therebetween so as to be slidable therealong, said complementary window sash also being removable from a secured position between said corresponding initial window sash channels.

11. The apparatus of claim 3 wherein said complementary window sash is secured between said corresponding complementary window sash channels by protuberances which protrude from said complementary window sash window frame into said corresponding complementary window sash channels, and wherein said complementary window sash is removable from said corresponding complementary window sash channels by said protuberances being removed therefrom.

12. The apparatus of claim 4 wherein said initial window sash window frame has two of said protuberances fixedly protruding adjacent two corners thereof, and has two further of said protuberances selectively protruding adjacent two other corners thereof.

13. The apparatus of claim 4 wherein said side members of said outer frame each have a complementary window sash channel therein located adjacent a side of said initial window sash channel therein, and further comprising a complementary window sash having a window frame with at least one pane therein, said complementary window sash being positionable between said corresponding complementary window sash channels and movably secured therebetween so as to be slidable therealong, said complementary window sash also being removable from a secured position between said corresponding initial window sash channels.

14. The apparatus of claim 5 wherein said supplementary channels each have an inner side and an outer side with a said supplementary channel outer side separated from that corresponding other side supplementary channel outer side of that remaining said supplementary channel member by less than that separation occurring between those corresponding said inner sides of said supplementary channel, said outer sides of said supplementary channels also being separated from one another by less than that distance occurring between corresponding opposite sides of said blocking panel.

15. The apparatus of claim 6 wherein said relatively rigid members are provided in a coarse mesh to form a relatively rigid structure by joining some of said tubes to one another and affixing at least some of said tubes in said panel frame.

16. The apparatus of claim 6 wherein said security structure is affixed to said panel frame by tee keys having a trunk extending in one direction and a crosspiece extending in an orthogonal direction with said trunks of said keys inserted in hollow interiors of said tubes and said crosspieces of said keys inserted in openings in said panel frame.

17. The apparatus of claim 15 wherein said tubes in said security structure that extend in one direction are formed as a single body, and those remaining tubes extending in an orthogonal direction are each positioned along a corresponding one of a plurality of axes as one of a plurality of multiple body tubes that are joined along that axis to said single body bars crossed by that axis to form a corresponding cross link.

18. The apparatus of claim 16 wherein said tee key trunks have a series of protrusions and said panel frame has a series of protrusions in a portion thereof at each of said openings therein at which said tee key crosspieces are received.

19. The apparatus of claim 17 wherein said multiple body tubes are joined with said single body tubes by linear keys with each said linear key having a portion thereof inserted past an opening into a hollow interior of said single body bar and with that remaining portion of that said linear key having a series of protrusions and inserted in a hollow interior of a said multiple body bar.

20. The apparatus of claim 11 wherein said complementary window sash window frame has two of said protuberances fixedly protruding adjacent two corners thereof, and has two further of said protuberances selectively protruding adjacent two other corners thereof.

* * * * *

UNITED STATES PATENT AND TRADEMARK OFFICE

CERTIFICATE OF CORRECTION

PATENT NO. : 5,927,364

DATED : JULY 27, 1999

INVENTOR(S) : BRYAN P. ZACHER ET AL.

It is certified that error appears in the above-identified patent and that said Letters Patent is hereby corrected as shown below:

Col. 3, line 67, after "frame 40", insert --and are shown retracted inwardly in FIG. 2--

Col. 4, line 20, after 'frame 40", insert --and are also shown retracted inwardly in FIG. 2--

Col. 7, line 28, delete "having", insert --being sufficiently small--

Col. 7, line 34, after "channels", insert --because of said panel being sufficiently large to have such removal thereof otherwise blocked by said initial window sash--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*